US005579544A

United States Patent [19]

Attler

[11] Patent Number: 5,579,544

[45] Date of Patent: Dec. 3, 1996

[54] LIFTABLE SEAT FOR BATHTUBS

[76] Inventor: Anthony R. Attler, 74 Price St., Dobbs Ferry, N.Y. 10522

[21] Appl. No.: 489,153

[22] Filed: Jun. 6, 1995

[51] Int. Cl.[6] ..... A47K 3/02

[52] U.S. Cl. ..... 4/566.1; 297/DIG. 8

[58] Field of Search ..... 4/564.1, 565.1, 4/566.1, 560.1, 561.1, 562.1, 563.1; 297/DIG. 3, DIG. 8

[56] References Cited

U.S. PATENT DOCUMENTS

| | | | |
|---|---|---|---|
| 2,968,814 | 1/1961 | Ashby | 4/564.1 |
| 3,311,930 | 4/1967 | Bourke | 4/185 |
| 3,771,176 | 11/1973 | Herman, Sr. | 4/185 |
| 4,034,426 | 7/1977 | Hardwick et al. | 4/564.1 |
| 4,254,517 | 3/1981 | Herman, Jr. | 4/564 |
| 4,495,666 | 1/1985 | Herman, Jr. | 4/564 |
| 5,377,366 | 1/1995 | Boyd et al. | 4/563.1 X |

FOREIGN PATENT DOCUMENTS

| | | | |
|---|---|---|---|
| 9111133 | 8/1991 | WIPO | 4/566.1 |

*Primary Examiner*—Charles E. Phillips
*Attorney, Agent, or Firm*—Richard L. Miller, P.E.

[57] ABSTRACT

A lightweight portable inflatable chair that includes a rigid tubular frame, a seat, and an inflatable cushion. The seat is movably mounted on the rigid tubular frame and has a seat maximum position and a seat minimum position. The inflatable cushion moves the seat from the seat maximum position to the seat minimum position and visa-versa. The inflatable cushion is removably mounted within the rigid tubular frame below the seat so that when a user sits on the seat the user can be raised and lowered to any desired elevation.

16 Claims, 1 Drawing Sheet

FIG. 1
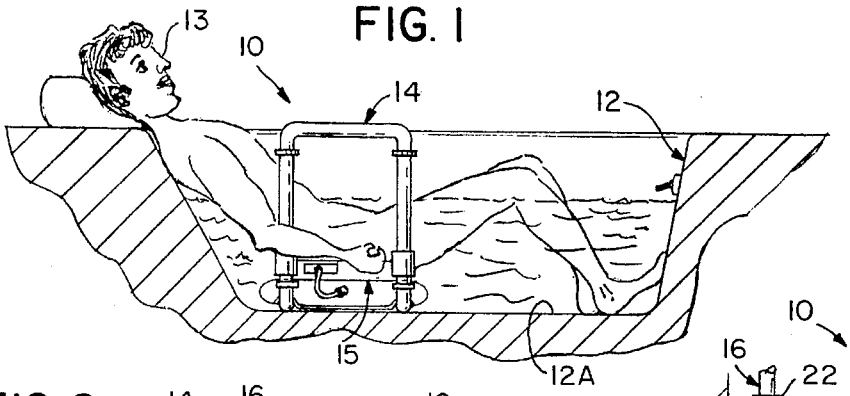
FIG. 2
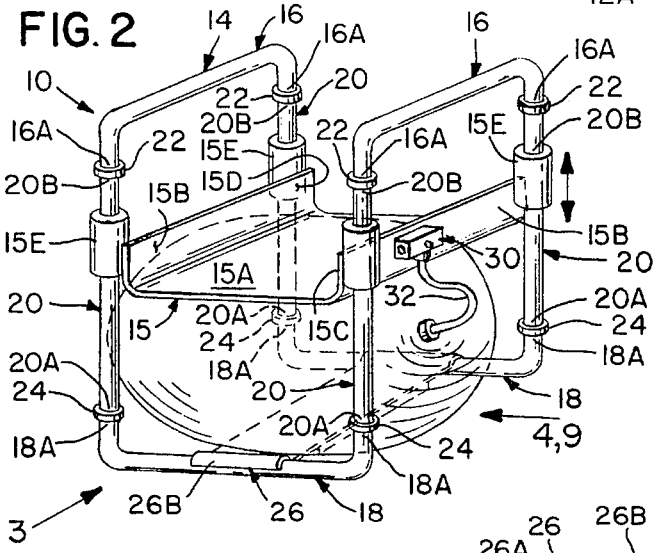
FIG. 3
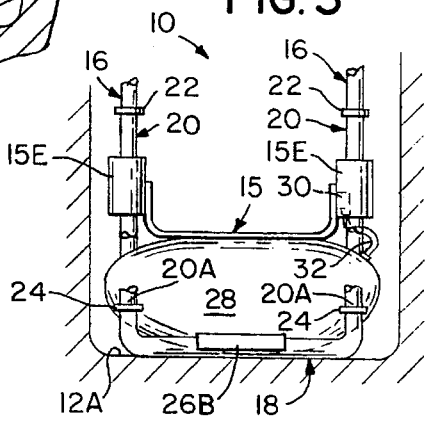
FIG. 4
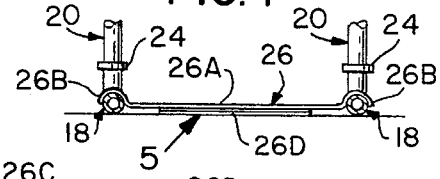
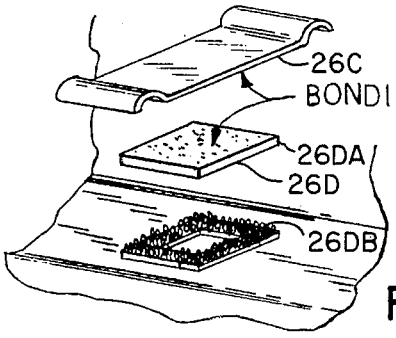
FIG. 7
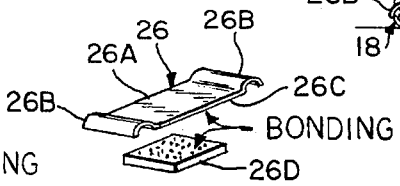
FIG. 6
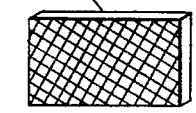
FIG. 5
FIG. 8
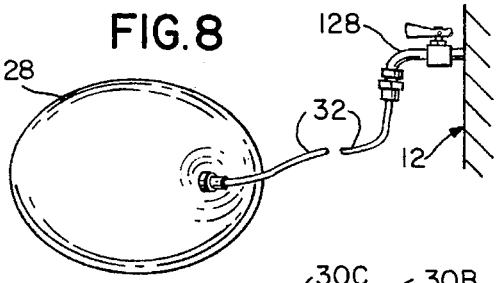
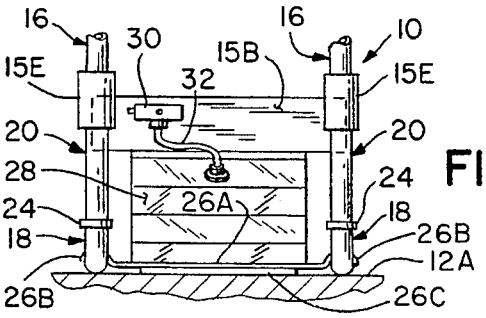
FIG. 9
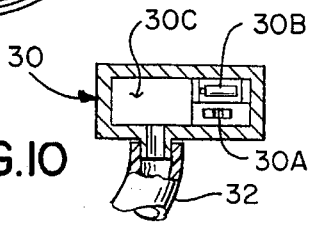
FIG. 10

LIFTABLE SEAT FOR BATHTUBS

BACKGROUND OF THE INVENTION

The present invention relates to a liftable seat for a bathtub. More particularly, the present invention relates to a liftable seat for a bathtub that is lightweight, truly portable with internal mini-compressor, and has automatic safety height stops.

It is extremely difficult for many people to take unattended baths because of the configuration of a conventional bathtub. Persons such as the handicapped, convalescents, expectant mothers, and the elderly often find it extremely difficult to utilize conventional bathtubs without assistance and such difficulties are often focused on their inability to lower themselves into the tub, and upon completion of the bath, to lift themselves out of the tub. Not only is the entrance and exit into and out of the tub for such users fraught with considerable difficulties, it is also extremely dangerous due to the ever present possibility of slippage.

Numerous devices have been developed for assisting bathers into and out of bathtubs. Some of these involve relatively complex, expensive equipment, and in general, are suitable only for use in hospitals and the like. Other devices, while less complex, have still been to expensive for use in the average household and have been subject to certain disadvantages such as lack of stability, durability, and the need for an external fluid supply.

For example, U.S. Pat. No. 3,771,176 teaches a cushion lift that has an inflatable cushion shell adapted to be positioned on the floor of a bathtub and must be connected to the bathtub spout or faucet. Water under pressure is fed through the bathtub spout into the inflatable shell to selectively inflate it to its full elevation wherein its supporting surface is elevated to the approximate height of the bathtub walls.

Another example, U.S. Pat. No. 3,311,930 to Bourke teaches an inflatable bathtub seat that includes three substantially rigid boards, one of which rests on the bathtub bottom, another of which has rigid, hinged connections to opposite ends of the upper and lower boards. A pair of inflatable bags are provided between the sloped, interconnecting board and the top and bottom boards.

Finally, other examples, U.S. Pat. Nos. 4,254,517 and 4,495,666 both to Herman, Jr. teach inflatable cushion assemblies that are positioned on the floor of a bathtub and must be connected to the bathtub faucet to inflate the cushion. They include a rigid bottom panel and/or rigid top panel. The interior of the cushion is provided with baffles. The cushion is tiered with layers that inflate in stages. The cushion is placed in a rigid chair like structure that has an apparatus on the chair back that cooperates with a side wall of the cushion. A foldable valve is provided. A plurality of interconnecting plates line the side walls, rear wall, and floor of the bathtub.

It is apparent that numerous innovations for liftable chairs have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, it is an object of the present invention to provide a liftable seat for bathtubs that avoids the disadvantages of the prior art.

Another object of the present invention is to provide a liftable seat for bathtubs that is simple and inexpensive to manufacture.

Still another object of the present invention is to provide a liftable seat for bathtubs that is simple to use.

Yet another object of the present invention is to provide a liftable seat for bathtubs that includes a rigid tubular frame, a seat, and an inflatable cushion.

Still yet another object of the present invention is to provide a liftable chair for bathtubs wherein the seat is movably mounted on the rigid tubular frame and has a seat maximum position and a seat minimum position.

Yet still another object of the present invention is to provide a liftable chair for bathtubs wherein the inflatable cushion moves the seat from the seat maximum position to the seat minimum position and visa-versa.

Still yet another object of the present invention is to provide a liftable chair for bathtubs wherein the inflatable cushion is removably mounted within the rigid tubular frame below the seat so that when a user sits on the seat the user can be raised and lowered to any desired elevation.

Yet still another object of the present invention is to provide a liftable chair for bathrooms wherein the rigid tubular frame has a pair of inverted "U"-shaped rigid tubular frame handrails, two pair of rigid tubular frame vertical guide rails connected to the pair of inverted "U"-shaped rigid tubular frame handrails, and a pair of "U"-shaped rigid tubular frame lower crossmembers connected to the two pair of rigid tubular frame vertical guide rails.

Still yet another object of the present invention is to provide a liftable chair for bathtubs that further includes a pair of upper couplings that connect the pair of inverted "U"-shaped rigid tubular frame handrails to the two pair of rigid tubular frame vertical guide rails.

Yet still another object of the present invention is to provide a liftable chair for bathtubs wherein the two pair of upper couplings act as stops when the chair achieves the chair maximum position.

Still yet another object of the present invention is to provide a liftable chair for bathtubs that further includes two pair of lower couplings that connects the pair of "U"-shaped rigid tubular frame lower crossmembers to the two pair of rigid tubular frame vertical guide rails.

Yet still another object of the present invention is to provide a liftable chair for bathtubs wherein the two pair of lower couplings act as stops when the chair achieves the chair minimum position.

Still yet another object of the present invention is to provide a liftable chair for bathtubs that further includes inflating apparatus for inflating the inflatable cushion.

Yet still another object of the present invention is to provide a liftable chair for bathtubs wherein the inflating apparatus includes a fluid, Still yet another object of the present invention is to provide a liftable chair for bathtubs wherein the fluid is water supplied from a faucet through a flexible tube to the inflatable cushion.

Yet still another object of the present invention is to provide a liftable chair for bathtubs wherein the inflating apparatus includes air, Still yet another object of the present invention is to provide a liftable chair for bathtubs that further includes air supplying apparatus for supplying the air.

Yet still another object of the present invention is to provide a liftable chair for bathtubs wherein the air supplying apparatus is disposed on the seat, Still yet another object of the present invention is to provide a liftable chair for bathtubs wherein the air supplying apparatus includes a mini-air compressor and a power supply for powering the mini-compressor.

Yet still another object of the present invention is to provide a liftable chair for bathtubs wherein the air supplying apparatus further includes a switch that electrically connects the power supply to the mini-compressor.

Still yet another object of the present invention is to provide a liftable chair for bathtubs wherein the power supply is selected from a group consisting of batteries and a AC power source.

Yet still another object of the present invention is to provide a liftable chair for bathtubs wherein the seat has a seat base from which a pair of seat sides extend upwardly.

Still yet another object of the present invention is to provide a liftable chair for bathtubs wherein the seat further has a pair of seat sleeves disposed on each of the pair of seat sides and ride on the two pair of rigid tubular frame vertical guide rails.

Yet still another object of the present invention is to provide a liftable chair for bathtubs that further includes an anti-skid plate that connects the pair of "U"-shaped rigid tubular frame lower crossmembers to each other.

Still yet another object of the present invention is to provide a liftable chair for bathtubs wherein the anti-skid plate has an anti-skid plate lower surface to which an anti-skid pad is attached.

Finally, another object of the present invention is to provide a liftable chair for bathtubs wherein the anti-skid pad is a hook and loop pile fastener material.

The novel features which are characteristic of the present invention are set forth in the appended claims. The invention itself, however, both as to its construction and its methods of operation, together with additional objects and advantages thereof, will be best understood from the following description of the specific embodiments when read and understood in connection with the accompanying drawing.

BRIEF DESCRIPTION OF THE DRAWINGS

FIG. 1 is a diagrammatic elevational view partially in section illustrating the instant invention in use;

FIG. 2 is a diagrammatic perspective view of the instant invention per se;

FIG. 3 is an end view taken in the direction of arrow 3 in FIG. 2 illustrating the fluid cushion partially inflated;

FIG. 4 is a diagrammatic elevational view with parts broken away taken in the direction of arrow 4 in FIG. 2;

FIG. 5 is an enlarged diagrammatic perspective view of a non-skid mat of the instant invention indicated by arrow 5 in FIG. 4;

FIG. 6 is a diagrammatic exploded perspective view showing an anti-skid plate and non-skid mat being bonded together;

FIG. 7 is a diagrammatic exploded perspective view of another mechanism for temporarily securing the instant invention in place;

FIG. 8 is a diagrammatic view illustrating the fluid cushion per se being inflated from a typical fluid source;

FIG. 9 is an elevational view taken in the direction of arrow 9 in FIG. 2; and FIG. 10 is a side elevational cutaway view showing the internal workings of the inflating arrangement,

LIST OF REFERENCE NUMERALS UTILIZED IN THE DRAWING liftable chair for bathtubs
12—bathtub
12A—bathtub floor
12B—bathtub faucet
13—user
14—rigid tubular frame
15—seat
15A—seat upper surface
15B—pair of seat ends
15C—seat open front
15D—seat open back
15E—two pair of seat sleeves
16—pair of inverted "U"-shaped handrails
16A—pair of inverted "U"-shaped handrail ends
18—pair of "U"-shaped crossmembers
18A—pair of "U"-shaped crossmember ends
20—two pair of vertical guide rails
20A—two pair of vertical guide rail lower ends
20B—two pair of vertical guide rail upper ends
22—two pair of upper couplings
24—two pair of lower couplings
26—anti-skid plate
26A—anti-skid plate base
26B—anti-skid plate ends
26C—anti-skid plate lower surface
26D—anti-skid pad
26DA—loop and hook fastener first portion
26DB—hook and loop fastener second portion
28—inflatable cushion
30—inflating arrangement
30A—three-way switch
30B—battery pack
30C—mini-compressor
32—flexible tube

DETAILED DESCRIPTION OF THE PREFERRED EMBODIMENT

Referring now to the figures in which like numerals indicate like parts and particularly to FIG. 1, the liftable seat for bathtubs of the present invention is shown generally at 10 with its frame 14 resting on the bathtub floor 12A of a bathtub 12 while a user 13 sits on the seat 15.

The overall structure of the liftable seat 10 can best be seen in FIGS. 2, 3 and 9, and as such, will be discussed with reference thereto.

The liftable seat 10 includes a hollow rigid frame 14 which includes a pair of tubular hollow parallel handrails 16, a pair of tubular hollow parallel lower crossmembers 18, and two pair of tubular hollow vertical guide rails 20. The hollow rigid frame is formed in a straddling configuration, is lightweight, and can be made from metal or plastic, but is not limited to that.

Each of the pair of tubular hollow parallel handrails 16 are substantially inverted "U"-shaped and have tubular hollow handrail ends 16A. Each of the two pair of tubular hollow vertical guide rails 20 has a tubular hollow vertical guide rail lower end 20A and a tubular hollow vertical guide rail upper end 20B that is connected to each of the tubular hollow parallel handrail lower ends 16A by upper couplings 22. Not only do the upper couplings 22 connect the pair of tubular hollow parallel handrails 16 to the two pair of tubular hollow vertical guide rails 20, but they also function as safety stops, limiting the maximum elevation that the seat 15 can be raised relative to the hollow rigid frame 14 so that accidental over raising of the seat 15 and possible injury to the user 13 is prevented.

Each of the pair of tubular hollow parallel lower crossmembers 18 are substantially "U"-shaped and have tubular hollow crossmember ends 18A that are connected to each of the tubular hollow vertical guide rail lower ends 20A by lower couplings 24. Not only do the lower couplings 24 connect the pair of tubular hollow parallel crossmembers 18 to the two pair of tubular hollow vertical guide rails 20, but they also function as safety stops, limiting the minimum elevation that the seat 15 can be lowered relative to the hollow rigid frame 14.

As can be seen, the straddling configuration of the hollow rigid frame 14 is achieved by the pair of tubular hollow lower crossmembers 18 being displaced 90 degrees relative to the pair of tubular hollow handrails 16. The straddling configuration of the hollow rigid frame 14 is further maintained by the structure of the seat 15 and of a anti-skid plate 26. The overall structure of the hollow rigid frame 14 prevents the liftable seat 10 from rocking or oscillating, especially during use, and preventing possible injury to the user 13.

The seat 15 has a seat base 15A, a pair of seat sides 15B that project upwardly from the seat base 15A, a seat opened front 15C, and a seat opened back 15D. The pair of seat sides 15B allow the user 13 to be cradled on and supported within the seat 15 while the seat open front 15C and the seat opened back 15D allow the user to extend comfortably from the inflatable chair 10.

Disposed on each of the seat sides 15B are a pair of seat sleeves 15E. The pair of seat sleeves 15E are attached to the seat 15 or may be integrally formed therewith, but is not limited to that. Each of the pair of seat sleeves 15E is concentrically disposed relative to each of the two pair of tubular hollow vertical guide rails 20, and as such, is movable along their length towards the tubular hollow vertical guide rail upper end 20B and towards the tubular hollow vertical guide rail lower end 20A. This provision allows the seat 15 to be readily raised and lowered relative to the rigid frame 14.

An inflatable cushion 28 is removably mounted between the seat 15 and the anti-skid plate 26. An inflating arrangement 30 is located on the outer side of one of the pair of seat sides 15B. The inflating arrangement 30 is in fluid communication with the inflatable cushion 28 via a flexible tube 32.

The configuration of the inflating arrangement can best be seen in FIG. 10, and as such will be discussed with reference thereto. The inflating arrangement 30 includes a three-way switch 30A, a mini-compressor 30B, and a battery pack 30C. The three-way switch 30A has a neutral position, a raise position, and a lower position. The inflating arrangement 30 allows the liftable chair 10 to be totally portable and not be dependent upon an external fluid source, such as a water faucet, to inflate and deflate the inflatable cushion 28.

However, as shown in FIG. 8, the liftable chair 10 may also be connected directly to the bathtub faucet 12B if the fluid supply to the inflatable cushion 28 is to be water. The flexible tube 32 extending from the inflatable cushion 28 is connected directly to the bathtub faucet 12B.

The configuration of the anti-skid plate 28 can best be seen in FIGS. 2–6 and 9, and as such, will be discussed with reference thereto. The anti-skid plate 26 has an anti-skid plate base 26A, a pair of anti-skid plate ends 26B that extend outwardly from the anti-skid plate base 26A in a concave manner. The concave design of the anti-skid plate ends 26A allow the anti-skid plate 26 to securely rest on the pair of hollow tubular lower crossmembers 18. Bonded to the anti-skid plate bottom surface 26C is an anti-skid pad 26D. The anti-skid pad 26D prevents the liftable chair 10 from skidding relative to the bathtub floor 12A by virtue of the inflatable cushion 28 exerting a downward force on the anti-skid plate 26 which in turn sandwiches the pair of tubular hollow crossmembers 18 therebetween. This again prevents possible injury to the user 13.

To further secure the liftable chair 10 to the bathtub floor 12A, as shown in FIG. 7, the anti-skid pad 26D can be so configured as a VELCRO(TM) fastener and include a loop and fastener first portion 26DA and a loop and fastener second portion 26DB. The loop and fastener first portion 26DA is bonded to the anti-skid plate bottom surface 26C while the loop and fastener second portion is affixed to the bathtub floor 12A.

In operation, while the liftable chair 10 is outside the bathtub 12, the user 13 moves the three-way switch 30A to the raise position which activates the mini-compressor 30B that is powered by the battery pack 30C. The operating mini-compressor 30B discharges air through the flexible tube 32 into the inflatable cushion 28 and inflates same. The inflatable cushion 28 raises the seat 15 and continues to inflate to the desired height at which point the user 13 releases the three-way switch 30A which then automatically returns to the neutral position. If the three-way switch is not released by the user 13, the seat 15 will continue to rise until the seat sleeves 15E hit the upper couplings 22 at which point the compressor is automatically halted and the seat stops rising. The liftable chair 10 is now placed in the bathtub 12, resting on the bathtub floor 12A. The user 13 now safely enters the bathtub 12 and sits on the seat 15 and again activates the thee-way switch 30A, but this time to the lower position. A relief valve (not shown) opens and the inflatable cushion 28 is deflated until the user 13 releases the three-way switch 30A or until the seat sleeves 15E hit the lower couplings 24 at which time the relief valve is automatically closed and the seat 15 stops lowering. The user 13 then proceeds to bath. Upon completion of the bath, the user 13 returns the three-way switch 30A to the raise position and the seat 28 again rises to the desired height. The user 13 then releases the three-way switch 30A automatically returning it to the neutral position. The user 13 can now safely leave the bathtub 12 with the seat 15 in position for the next use.

It will be understood that each of the elements described above, or two or more together, may also find a useful application in other types of constructions differing from the types described above.

While the invention has been illustrated in a liftable chair for bathtubs, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed as new and desired to be protected by Letters Patent is set forth in the appended claims.

The invention claimed is:

1. A lightweight portable chair, comprising:

a) a rigid tubular frame, said rigid tubular frame having a pair of inverted "U"-shaped rigid tubular frame handrails, two pair of rigid tubular frame vertical guide rails connected to said pair of inverted "U"-shaped rigid tubular frame handrails, and a pair of "U"-shaped rigid tubular frame lower crossmembers connected to said two pair of rigid tubular frame vertical guide rails;

b) a seat movably mounted on said rigid tubular frame and having a seat maximum position and a seat minimum position;

c) an inflatable cushion for moving said seat from said maximum position to said seat minimum position and visa-versa and being removably mounted within said rigid tubular frame below said seat so that when a user sits on said seat said user can be raised and lowered to any desired elevation; and d) two pair of upper couplings connecting said pair of inverted "U"-shaped rigid tubular frame handrails to said two pair of rigid tubular frame vertical guide rails; said two pair of upper couplings acting as stops when said chair achieves said chair maximum position.

2. The chair as defined in claim 1, wherein said seat has a seat base from which a pair of seat sides extend upwardly.

3. The chair as defined in claim 2, wherein said seat further has a pair of seat sleeves disposed on each of said pair of seat sides and ride on said two pair of rigid tubular frame vertical guide rails.

4. The chair as defined in claim 1; further comprising two pair of lower couplings connecting said pair of "U"-shaped rigid tubular frame lower crossmembers to said two pair of rigid tubular frame vertical guide rails, said two pair of lower couplings acting as stops when said chair achieves said chair minimum position.

5. The chair as defined in claim 4; further comprising inflating means for inflating said inflatable cushion.

6. The chair as defined in claim 5, wherein said inflating means includes a fluid.

7. The chair as defined in said 6, wherein said fluid is water supplied from a faucet through a flexible tube to said inflatable cushion.

8. The chair as defined in claim 5, wherein said inflating means includes air.

9. The chair as defined in claim 8; further comprising air supplying means for supplying said air.

10. The chair as defined in claim 9, wherein said air supplying means is disposed on said seat.

11. The chair as defined in claim 10, wherein said air supplying means includes a mini-air compressor and a power supply for powering said mini-compressor.

12. The chair as defined in claim 11, wherein said air supplying means further includes a switch that electrically connects said power supply to said mini-compressor.

13. The chair as defined in claim 12, wherein said power supply is selected from a group consisting of batteries and a AC power source.

14. The chair as defined in claim 1; further comprising an anti-skid plate connecting said pair of "U"-shaped rigid tubular frame lower crossmembers to each other.

15. The chair as defined in claim 14, wherein said anti-skid plate has an anti-skid plate lower surface to which an anti-skid pad is attached.

16. The chair as defined in claim 15, wherein said anti-skid pad has a portion of hook and loop fasteners disposed thereon.

* * * * *